US005410772A

United States Patent [19]

Lewis

[11] Patent Number: 5,410,772

[45] Date of Patent: May 2, 1995

[54] FLOOR WASHING MOP

[76] Inventor: Leon S. Lewis, P.O. Box 5410, Chattanooga, Tenn. 37406

[21] Appl. No.: 259,231

[22] Filed: Jun. 13, 1994

[51] Int. Cl.[6] ..... A47L 13/20

[52] U.S. Cl. ..... 15/228; 15/106; 15/160; 15/231; 15/247

[58] Field of Search ..... 15/106, 159.1, 160, 15/147.1, 148, 150, 228, 231, 232, 247

[56] References Cited

U.S. PATENT DOCUMENTS

| | | | |
|---|---|---|---|
| 693,245 | 2/1902 | Derr | 15/231 |
| 866,897 | 9/1907 | Willey | 15/232 |
| 867,479 | 10/1907 | Childress | 15/231 |
| 869,842 | 10/1907 | Hill | 15/231 |
| 1,205,979 | 11/1916 | Dohm | 15/231 |
| 1,353,429 | 9/1920 | Severns | 15/231 |
| 1,540,120 | 6/1925 | Hammerle | 15/231 |
| 2,875,460 | 3/1959 | Legge | 15/247 |
| 3,034,165 | 5/1962 | Christian | 15/247 |
| 3,054,132 | 9/1962 | Ormerod | 15/247 |
| 3,099,855 | 8/1963 | Nash | 15/231 |
| 3,199,136 | 8/1965 | George | 15/247 |
| 3,261,049 | 7/1966 | Murphy | 15/231 |
| 3,315,296 | 4/1967 | Richardson | 15/159.1 |
| 4,225,998 | 10/1980 | Thielen | 15/231 |

FOREIGN PATENT DOCUMENTS

| | | | |
|---|---|---|---|
| 583957 | 9/1959 | Canada | 15/160 |
| 645139 | 10/1928 | France | 15/160 |
| 749457 | 5/1933 | France | 15/106 |
| 709237 | 8/1941 | Germany | 15/247 |
| 107351 | 5/1943 | Sweden | 15/231 |
| 112773 | 11/1925 | Switzerland | 15/231 |
| 166721 | 4/1934 | Switzerland | 15/247 |
| 199734 | 11/1938 | Switzerland | 15/247 |
| 280117 | 4/1952 | Switzerland | 15/231 |

*Primary Examiner*—Mark Spisich
*Attorney, Agent, or Firm*—Alan Ruderman

[57] ABSTRACT

A floor washing mop has a rigid base carrying fixed scrubbing members on the bottom surface. The scrubbing members may be stiff flexible bristles or rigid elastomeric rails. A rabbet is formed at each side of the base stepped down from the upper surface of the base and a groove is stepped down from the upper surface and extends between the rabbets adjacent the front of the base. A U-shape clamp is pivoted to the base and receivable within the rabbets and the groove. A fabric covering is positionable about the entire base including the scrubbing members and foldable so as to rest on the top of the base and is held securely in position by the clamp. A locking member mounted on the upper surface of the base locks the clamp on the covering.

13 Claims, 1 Drawing Sheet

FLOOR WASHING MOP

BACKGROUND OF THE INVENTION

This invention relates to cleaning implements and more particularly to a mop having scrubbing elements over which a replaceable web of covering material is folded and clamped, the covering receiving the dirt and grime as the mop is used to wash and scrub a floor.

Mops of various designs have been developed over the years for washing floors. For example, the conventional string or rope type mops absorb a substantial amount of water or a cleaning solution and are useful when a floor surface is to be washed, but they are inefficient when a scrubbing action is required. Additionally, after a number of uses the string or rope elements become excessively soiled and worn and require replacement. These elements are generally affixed to a base which must also be replaced as a unit. The same deficiencies are presented by mops of this design wherein fabric or other material comprise string-like elements. The development of sponge or artificial sponge mops, that is, mops having a sponge or artificial sponge as the cleaning solution absorption element, provide a more efficient scrubbing action than the string type mops, but the useful life of the sponge portion of such mops is very limited, not only because the sponge wears rapidly, but because it quickly takes on a sour smelling odor. Such mops cannot be washed in a washing machine or the like. Moreover, even though the scrubbing ability of the sponge or artificial sponge is substantially greater than that of the string or rope mops, many people when washing a floor prefer to use a hand-held hard bristle brush because of the greater scrubbing or scouring abilities it provides to the floor surface.

BACKGROUND OF THE INVENTION

Consequently, it is a primary object of the present invention to provide a floor washing mop which provides greater scrubbing capabilities than that of the prior art mops.

It is another object of the present invention to provide a floor washing mop which includes scrubbing elements and a removable covering positioned over the scrubbing elements.

It is a further object of the present invention to provide a floor washing mop having a base on which either flexible or rigid scrubbing or massaging elements are secured, the base including the scrubbing elements being covered by a removable fabric and having clamping means for selectively securing the covering to the base, the covering being disposed for contacting a floor to be washed while the scrubbing elements forceably act against the covering to apply friction for scrubbing and scouring the floor.

Accordingly, the present invention provides a floor washing mop having a rigid base carrying fixed scrubbing or massaging elements on at least the bottom surface, the base having a pivotable clamp and locking means for selectively holding the clamp in position against an upper portion of the base, the mop further including a fabric covering positionable about the base including the scrubbing elements and folded over the upper portion so that the scrubbing elements are enclosed or covered by the covering, the covering being secured by the clamp and locking means to the base. A conventional handle is attached to the upper surface of the base so that the mop may be used in conventional manner. In one form of the invention the scrubbing elements are stiff bristles which may flex as the mop is forced against the floor. In another form of the invention the scrubbing elements are rigid members. In either case the scrubbers, whether flexible or rigid, preferably are disposed in at least two spaced apart rows for providing a massaging action which causes the covering to scour the floor.

The covering in the preferred form of the invention may merely be toweling material which may be removed after use and washed in a washing machine or the like. When the toweling is worn to the point of requiring replacement, another such web of material may be substituted readily without the need to replace the base of the mop. Since the scrubbing elements do not directly engage the floor, wear on these elements is minimized and the base may be used extensively.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENTS

Figure 1:
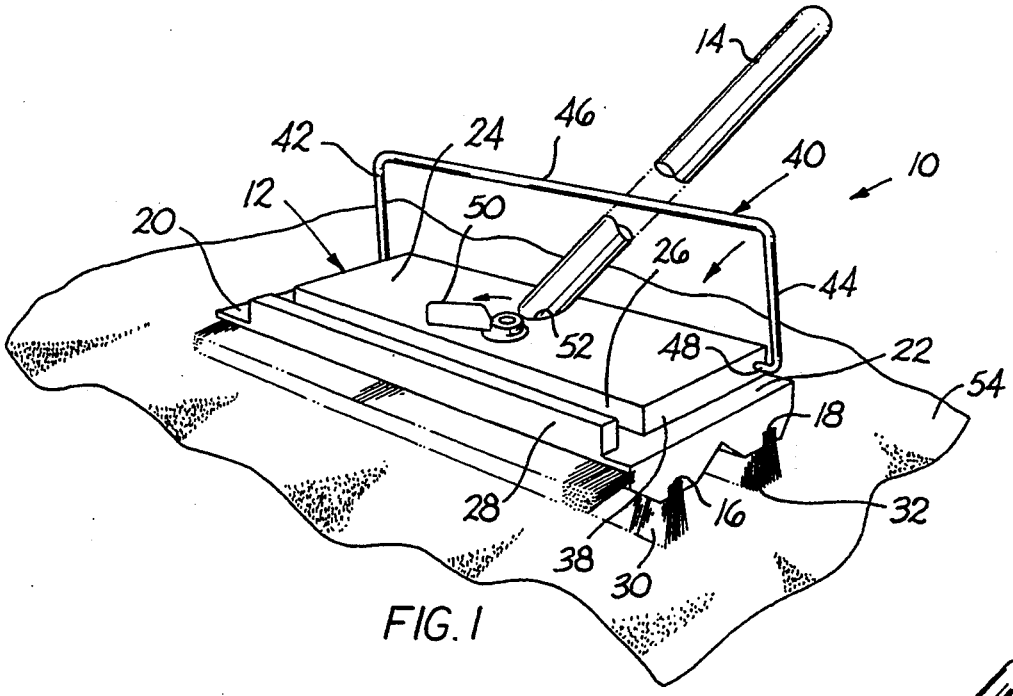
FIG. 1 is a perspective view of a floor washing mop constructed in accordance with the present invention illustrating a first embodiment of the scrubbing elements on the base of the mop and depicting the covering prior to attachment to the base.

Referring to the drawings, FIG. 1 illustrates a mop 10 constructed in accordance with a first form of the invention, the mop including a base 12 to an upper portion of which an elongated handle 14 is secured at a convenient angular disposition extending upwardly and rearwardly either selectively, by threading the end of the handle and tapping into a bored hole in the base, or relatively permanently by inserting the end of the handle into a bored hole and securing it by fasteners such as screws or the like. The base 12 may be a substantially rectangular block, preferably constructed from wood, plastic or any other conventional material, and includes at least first and second longitudinally extending grooves 16, 18 in the lower surface of the base extending from side-to-side and spaced apart transversely in the front-to-rear direction of the base. Additionally, the top of the base has a rabbet or groove 20, 22 at each side which forms a step down from the upper-most surface 24 of the base. An elongated groove 26 stepped down from the upper surface 24 the same amount as the rabbet grooves 20, 22 extends between the rabbet grooves spaced a small distance from the front wall 28 of the base.

Disposed within each groove 16, 18 is a respective multiplicity of bristles 30, 32, the bristles preferably being formed from plastic such as polypropylene or similar material which is stiff, but flexible. Ideally a plurality of fibers of the bristle material are braided or twisted together between the ends to form groups of bristle packs. The braided or twisted portions of the packs are thereafter inserted into the respective grooves 16, 18 with the ends of the fibers extending outwardly. After insertion into the respective groove each braided or twisted portion is secured therein by tacking or bonding or by other securing means. Alternatively, the bristles may be fixed within a strip of material, such as plastic, and the strip may then be positioned within the respective grooves 16, 18, or the bristle packs may be inserted into respective holes bored into the base 12 in a manner similar to that of hand held bristle scrub brushes. If desired, there may be a longitudinally extending groove 34 similar to the grooves 16 and 18 formed in the front wall 28 of the base for receiving another multiplicity of bristles 36 which may be used for cleaning the baseboard of a wall adjacent the floor to be washed.

Figure 2:
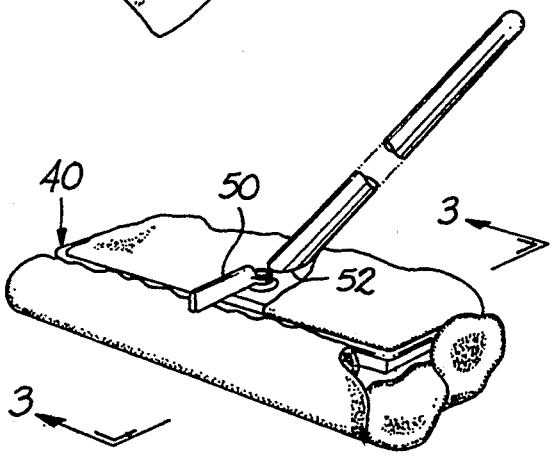
FIG. 2 is a view similar to FIG. 1 with the covering attached and the mop in the operative position.
Figure 3:
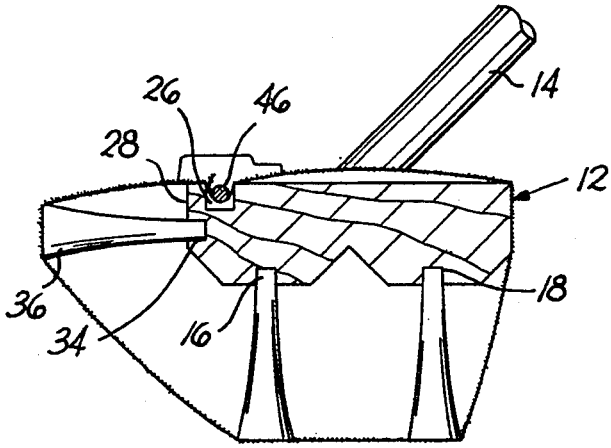
FIG. 3 is a cross sectional view taken substantially along line 3—3 of FIG. 2.

Pivotably journalled in the side walls 38 (only one of which is illustrated) between the upper surface 24 of the base and the respective rabbets 20, 22 is a clamp 40. The clamp has a substantially U-shaped configuration including a pair of spaced apart legs 42, 44 and a bridging portion 46. The ends of the legs 42, 44 are bent to form a pivot arm 48 (only one of which is illustrated) for receipt into a bore in the wall 38. The legs 42, 44 are thus disposed for resting on the respective rabbet 20, 22 when the clamp is pivoted from the position illustrated in FIG. 1 to the operative position illustrated in FIGS. 2 and 3. The length of the legs 42 and 44 are such that when the legs are on or adjacent the rabbet 20, 22, i.e., the clamp is pivoted to the operative position, the bridging portion 46 is disposed within the groove 26. Intermediate the sides of the base 12 spaced behind the groove 26 is a locking member in the form of a pivotably mounted tab 50, the tab being a lever journalled about a screw 52 or the like so that the free end of the tab, i.e., the end remote from the screw 52, may be superposed over and preferably extend forwardly of the front edge of the groove 26 to thereby prevent the bridging portion 46 of the clamp from exiting the groove 26 when the tab is in this locking position.

The mop also includes a covering in the form of a web of fabric 54 such as fabric towel material, and may comprise a conventional hand sized towel constructed from cotton or a blend of the various fibers conventionally used in towels. The bottom of the base 12 is positioned in the central portion of the fabric web 54, and the sides and ends and corners of the web are then folded onto the top of the base, around the handle, and positioned so that the longer sides overlap and are superposed over the groove 26, while the shorter sides are positioned to have portions thereof superposed over the rabbets 20, and 22. With the web of fabric so positioned in a taught manner, the clamp 40 may be pivoted to the operative position to hold the web of fabric 54 tightly against the base, portions of the fabric web being secured within the groove 26 and portions being secured to the surface of the rabbets 20, 22. When the fabric web is so positioned, the fabric covers the entire base and the locking tab 50 may be rotated to secure the clamp 40 and thus the covering in place.

In operation, the mop is used in conventional manner in that the fabric covering 54 is wetted with water or cleaning solution, and when the mop is pushed back and forth, the bristles 30, 32 act as scrubbers forcing the covering into a high friction relationship with the floor thereby resulting in an abrasive or scouring action on the floor. Since the bristles are disposed in at least two rows, an effective massaging type of action occurs. The result is a highly effective washing or cleaning of the floor surface.

Figure 4:
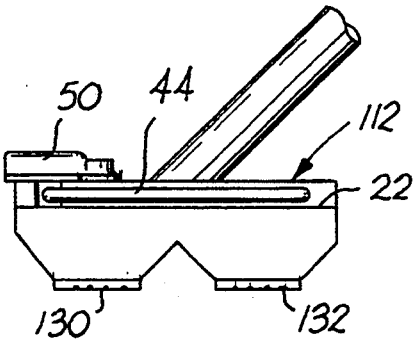
FIG. 4 is an end elevational view of the base portion of the mop showing a second embodiment of the scrubbing elements according to the invention.

FIG. 4 illustrates another embodiment of the mop wherein the base 112 rather than including bristles as in the first embodiment has rigid scrubbers in the form of ridged or serrated sails or feet 130, 132 secured to the underside of the base in laterally spaced apart relationship. Preferably the feet comprise strips of elastomeric material which may be rubber. In all other respects this embodiment is identical to the embodiment of FIGS. 1 through 3.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A wash mop comprising a base having upper and lower surfaces and including front and rear walls extending longitudinally between a pair of sides, scrubbing members secured to said lower surface and extending longitudinally in a pair of spaced apart rows, a handle fastened to said base and extending at an inclination upwardly and rearwardly, a clamping member pivotably mounted on said base, said base having clamping member receiving areas including a rabbet stepped down from said upper surface at each side of said base, and a groove stepped down from said upper surface extending intermediate said rabbets adjacent said front wall, said clamping member comprising a substantially U-shape member including a pair of substantially parallel legs and a bridging portion extending intermediate said legs pivoted to said base below said upper surface adjacent the rear wall, said legs .being receivable within a respective one of said rabbets and said bridging portion being receivable within said groove, said legs and said bridging portion being raised above said upper surface when said clamping member is in a first position and being disposed in said clamping member receiving areas when the clamping member is in a second position, a covering comprising a web of fabric material disposed about said base abutting and covering said scrubbing members, said web having a peripheral border positionable onto said upper surface with at least portions of said web superposed over said clamping member receiving areas while said clamping member is in said first position and held by said clamping member in said areas when said clamping member is in said second position, and locking means for locking said clamping member in said second position to selectively secure said covering to said base, said covering being disposed on said base when a floor is to be washed and thereafter may be removed.

2. A wash mop as recited in claim 1, wherein said locking means comprises a lever pivotably mounted on said upper surface adjacent said groove and movable from a disposition entirely rearwardly of said groove to a disposition where a portion of said lever is positioned over said groove.

3. A wash mop as recited in claim 1, wherein said scrubbing members comprise a multiplicity of stiff flexible bristles.

4. A wash mop as recited in claim 3, wherein said locking means comprises a lever pivotably mounted on said upper surface adjacent said groove and movable from a disposition entirely rearwardly of said groove to a disposition where a portion of said lever is positioned over said groove.

5. A wash mop as recited in claim 3, including an additional scrubbing member extending from said front wall of said base, said additional scrubbing member comprising a multiplicity of stiff flexible bristles.

6. A wash mop as recited in claim 5, wherein said locking means comprises a lever pivotably mounted on said upper surface adjacent said groove and movable from a disposition entirely rearwardly of said groove to a disposition where a portion of said lever is positioned over said groove.

7. A wash mop as recited in claim 1, wherein said scrubbing members comprise rigid members.

8. A wash mop as recited in claim 7, wherein said rigid members are elastomeric.

9. A wash mop as recited in claim 8, wherein said locking means comprises a lever pivotably mounted on said upper surface adjacent said groove and movable from a disposition entirely rearwardly of said groove to a disposition where a portion of said lever is positioned over said groove.

10. A wash mop as recited in claim 1, wherein said scrubbing members extend from one side of said base to the other side thereof.

11. A wash mop as recited in claim 10, wherein said scrubbing members comprise a multiplicity of stiff flexible bristles.

12. A wash mop as recited in claim 10, wherein said scrubbing members comprise rigid members.

13. A wash mop as recited in claim 12, wherein said rigid members are elastomeric.

* * * * *